US008225432B1

(12) United States Patent
Price

(10) Patent No.: US 8,225,432 B1
(45) Date of Patent: Jul. 24, 2012

(54) TOILET CLEAN-OUT ACCESS PANEL SYSTEM

(76) Inventor: David J. Price, Largo, FL (US)

( * ) Notice: Subject to any disclaimer, the term of this patent is extended or adjusted under 35 U.S.C. 154(b) by 187 days.

(21) Appl. No.: 12/655,001

(22) Filed: Dec. 22, 2009

Related U.S. Application Data

(60) Provisional application No. 61/204,011, filed on Dec. 31, 2008.

(51) Int. Cl.
*E03D 9/00* (2006.01)

(52) U.S. Cl. ..... 4/256.1

(58) Field of Classification Search ..... 4/256.1
See application file for complete search history.

(56) References Cited

U.S. PATENT DOCUMENTS 563,397 A * 7/1896 Morrison ..... 4/428
1,827,663 A * 10/1931 Mastrillo ..... 4/256.1

* cited by examiner

*Primary Examiner* — Huyen Le

(57) ABSTRACT

A toilet has an open top, a bottom positionable on a floor, a front, a rear and laterally spaced sides. A water passageway through the toilet is in a generally S-shaped configuration with a generally central P-trap. A cutout in the rear of the toilet has a vertical exterior edge, a vertical interior edge, a generally horizontal lower edge and a generally horizontal upper edge, the edges together forming a continuous bearing surface. A removable panel is shaped generally as a mirror image of the toilet between the upper and lower edges of the cutout and has a continuous bearing surface positionable to overlie the bearing surface of the cutout. Mating flanges are on the panel and the toilet adjacent to the bearing surfaces. Bolts with nuts extend through the holes in the flanges to allow separating the panel from the toilet.

5 Claims, 2 Drawing Sheets

TOILET CLEAN-OUT ACCESS PANEL SYSTEM

RELATED APPLICATION

This application is based upon and claims the benefit of Provisional Application No. 61/204,011 filed Dec. 31, 2008 the subject matter of which is incorporated herein by reference.

BACKGROUND OF THE INVENTION

1. Field of the Invention

The present invention relates to a toilet clean-out access panel system and more particularly pertains to cleaning out clogs of material in P-traps of toilets in a relatively clean, convenient and economical manner.

2. Description of the Prior Art

The use of toilet drain clog removing systems of known designs and configurations is known in the prior art. More specifically, toilet drain clog removing systems of known designs and configurations previously devised and utilized for the purpose of removing clogs from toilets are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe a toilet clean-out access panel system that allows cleaning out clogs of material in P-traps of toilets in a relatively clean, convenient and economical manner.

In this respect, the toilet clean-out access panel system according to the present invention substantially departs from the conventional concepts and designs of the prior art, and in doing so provides an apparatus primarily developed for the purpose of cleaning out clogs of material in P-traps of toilets in a relatively clean, convenient and economical manner.

Therefore, it can be appreciated that there exists a continuing need for a new and improved toilet clean-out access panel system which can be used for cleaning out clogs of material in P-traps of toilets in a relatively clean, convenient and economical manner. In this regard, the present invention substantially fulfills this need.

SUMMARY OF THE INVENTION

In view of the disadvantages inherent in the known types of toilet drain clog removing systems of known designs and configurations now present in the prior art, the present invention provides an improved toilet clean-out access panel system. As such, the general purpose of the present invention, which will be described subsequently in greater detail, is to provide a new and improved toilet clean-out access panel system and method which has all the advantages of the prior art and none of the disadvantages.

To attain this, the present invention essentially comprises a toilet fabricated of porcelain and having an open top for the receipt of material to be flushed away. The toilet also has a bottom positionable on a recipient surface. The toilet also has a front in a broadly curved configuration. The toilet also has a rear in a narrowly curved configuration and laterally spaced sides. The toilet has a vertical central plane and is symmetric about the vertical central plane.

Next provided is a tank. The tank is secured to the toilet and extends upwardly from the rear of the toilet. The tank is adapted to contain a quantity of water for passage through the toilet to flush material through the toilet.

A water passageway is next provided. The water passageway is through the toilet from the top to the bottom in a generally S-shaped configuration. The S-shaped configuration includes a central P-trap in a generally inverted U-shaped configuration. The P-trap is adapted to preclude the upward flow of unpleasant gasses from beneath the toilet. The P-trap creates a region susceptible of retaining a clog of unwanted material during a flushing which, if not unclogged, will result in an overflowing of the toilet.

Next provided is a cutout in the rear of the toilet. The cutout has a vertical exterior edge in the vertical plane of the toilet and forms a bearing surface in a generally S-shaped configuration. The cutout has a vertical interior edge forming a bearing surface in a generally S-shaped configuration at a fixed distance from the exterior edge. The cutout has a generally horizontal lower edge 42 forming a bearing surface in a generally C-shaped configuration adjacent to the bottom of the toilet. The cutout has a generally horizontal upper edge forming a bearing surface in a generally C-shaped configuration adjacent to the top of the toilet.

A removable panel is next provided. The removable panel is shaped generally as a mirror image of the toilet between the upper and lower edges of the cutout. The removable panel has bearing surfaces positionable to overlie the bearing surfaces of the cutout.

A gasket is next provided. The gasket is shaped to correspond to the bearing surfaces of the cutout and the panel. The gasket is positioned between the cutout and the panel during operation and use of the toilet for abating water leakage. The gasket is fabricated of an elastomeric material selected from the class of elastomeric materials including plastic and rubber, natural or synthetic, or blends thereof.

Mating flanges are next provided on the panel and the toilet adjacent to the vertical edges. The mating flanges include a short flange near the exterior and horizontal edges. The mating flanges include a long flange above the short flange and an intermediate flange along the interior edge. The flanges are formed with holes. Bolts extend through the holes. Nuts couple to the bolts to allow separating the panel from the toilet for the purpose of removing clogs.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is, therefore, an object of the present invention to provide a new and improved toilet clean-out access panel system which has all of the advantages of the prior art toilet clean-out systems of known designs and configurations and none of the disadvantages.

It is another object of the present invention to provide a new and improved toilet clean-out access panel system which may be easily and efficiently manufactured and marketed.

It is a further object of the present invention to provide a new and improved toilet clean-out access panel system which is of durable and reliable constructions.

An event further object of the present invention is to provide a new and improved toilet clean-out access panel system which is susceptible of a low cost of manufacture with regard to both materials and labor, and which accordingly is then susceptible of low prices of sale to the consuming public, thereby making such toilet clean-out access panel system economically available to the buying public.

Even still another object of the present invention is to provide a toilet clean-out access panel system for cleaning out clogs of material in P-traps of toilets in a relatively clean, convenient and economical manner.

Lastly, it is an object of the present invention to provide a new and improved toilet having an open top, a bottom positionable on a floor, a front, a rear and laterally spaced sides. A water passageway is provided through the toilet in a generally S-shaped configuration with a generally central P-trap. A cutout in the rear of the toilet has a vertical exterior edge, a vertical interior edge, a generally horizontal lower edge and a generally horizontal upper edge. The edges together form a continuous bearing surface. A removable panel shaped generally as a mirror image of the toilet is provided between the upper and lower edges of the cutout. The removable panel has a continuous bearing surface positionable to overlie the bearing surface of the cutout. Mating flanges are provided on the panel and the toilet adjacent to the bearing surfaces. The flanges are formed with holes. Bolts extend through the holes. Nuts are coupled to the bolts. In this manner separating of the panel from the toilet is allowed.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
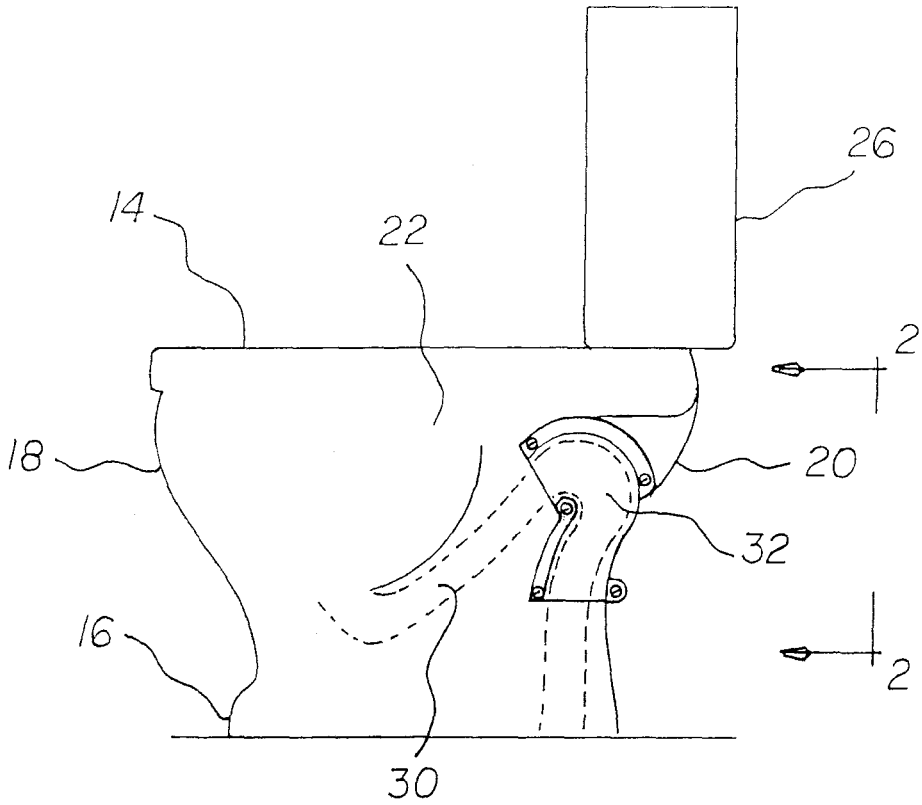
FIG. 1 is a side elevational view of a toilet clean-out access panel constructed in accordance with the principles of the present invention.
Figure 2:
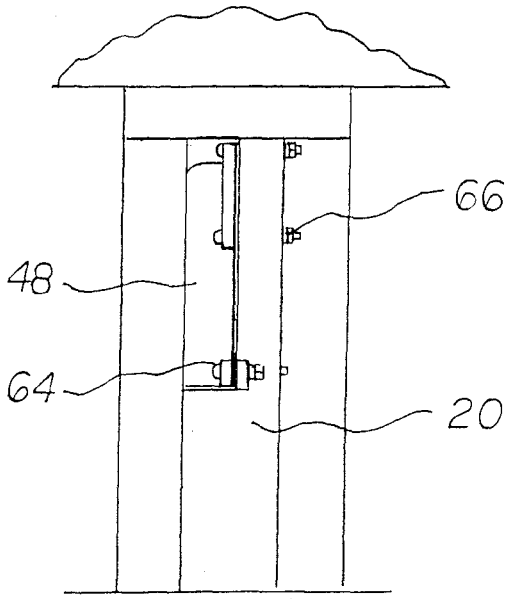
FIG. 2 is a rear elevational view of the toilet clean-out access panel taken at line 2-2 of FIG. 1
Figure 3:
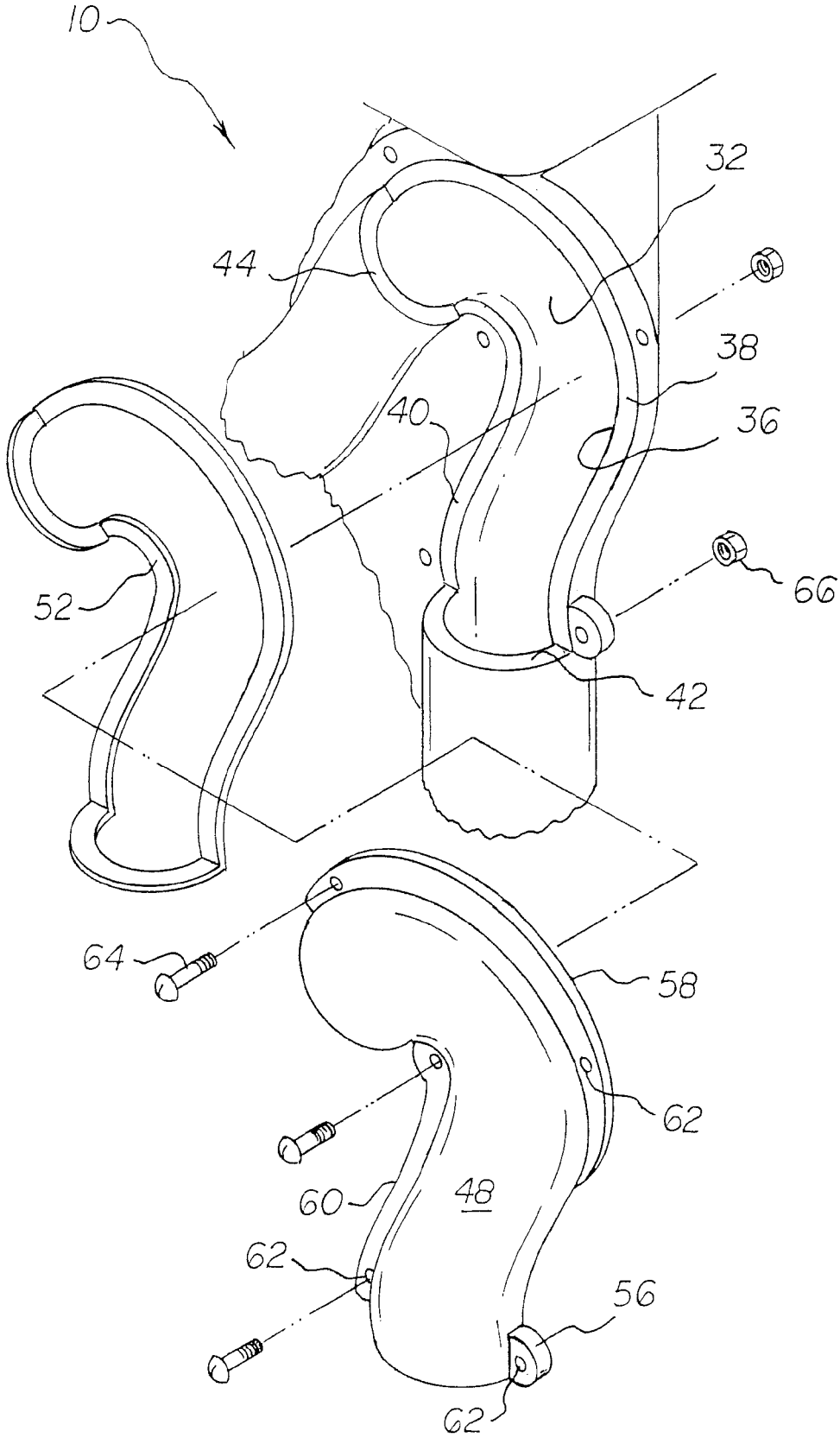
FIG. 3 is an exploded perspective illustration of the toilet clean-out access panel of the prior Figures.

With reference now to the drawings, and in particular to FIG. 1 thereof, the preferred embodiment of the new and improved toilet clean-out access panel system embodying the principles and concepts of the present invention and generally designated by the reference numeral 10 will be described.

The present invention, the toilet clean-out access panel system 10 is comprised of a plurality of components. Such components in their broadest context include a toilet, a water passageway, a cutout in the rear of the toilet, a removable panel, and mating flanges. Such components are individually configured and correlated with respect to each other so as to attain the desired objective.

The toilet clean-out access panel system 10 of the present invention is for cleaning out clogs of material in P-traps of toilets. The cleaning out being achieved in a relatively clean, convenient and economical manner is comprised of a plurality of components. Such components in their broadest context include a toilet with a water passageway, a cutout in the rear of the toilet, a removable panel and mating flanges on the panel and toilet. Such components are individually configured and correlated with respect to each other so as to attain the desired objective.

First provided is a toilet fabricated of porcelain and having an open top 14 for the receipt of material to be flushed away. The toilet also has a bottom 16 positionable on a recipient surface. The toilet also has a front 18 in a broadly curved configuration. The toilet also has a rear 20 in a narrowly curved configuration and laterally spaced sides 22. The toilet has a vertical central plane and is symmetric about the vertical central plane.

Next provided is a tank 26. The tank is secured to the toilet and extends upwardly from the rear of the toilet. The tank is adapted to contain a quantity of water for passage through the toilet to flush material through the toilet.

A water passageway 30 is next provided. The water passageway is through the toilet from the top to the bottom in a generally S-shaped configuration. The S-shaped configuration includes a central P-trap 32 in a generally inverted U-shaped configuration. The P-trap is adapted to preclude the upward flow of unpleasant gasses from beneath the toilet. The P-trap creates a region susceptible of retaining a clog of unwanted material during a flushing which, if not unclogged, will result in an overflowing of the toilet.

Next provided is a cutout 36 in the rear of the toilet. The cutout has a vertical exterior edge 38 in the vertical plane of the toilet and forms a bearing surface in a generally S-shaped configuration. The cutout has a vertical interior edge 40 forming a bearing surface in a generally S-shaped configuration at a fixed distance from the exterior edge. The cutout has a generally horizontal lower edge 42 forming a bearing surface in a generally C-shaped configuration adjacent to the bottom of the toilet. The cutout has a generally horizontal upper edge 44 forming a bearing surface in a generally C-shaped configuration adjacent to the top of the toilet.

A removable panel 48 is next provided. The removable panel is shaped generally as a mirror image of the toilet between the upper and lower edges of the cutout. The removable panel has bearing surfaces positionable to overlie the bearing surfaces of the cutout.

A gasket 52 is next provided. The gasket is shaped to correspond to the bearing surfaces of the cutout and the panel. The gasket is positioned between the cutout and the panel during operation and use of the toilet for abating water leakage. The gasket is fabricated of an elastomeric material selected from the class of elastomeric materials including plastic and rubber, natural or synthetic, or blends thereof.

Mating flanges 56, 58, 60 are next provided on the panel and the toilet adjacent to the vertical edges. The mating flanges include a short flange 56 near the exterior and horizontal edges. The mating flanges include a long flange 58 above the short flange and an intermediate flange 60 along the interior edge. The flanges are formed with holes 62. Bolts 64 extend through the holes. Nuts 66 couple to the bolts to allow separating the panel from the toilet for the purpose of removing clogs.

The preferred embodiment of the present invention is described as being employed in a toilet. It should be understood, however, that the present invention is also adapted to be utilized in other environments, as for example, in wall urinals and the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet access panel system comprising:

a toilet having an open top, a bottom positionable on a floor, a front, a rear and laterally spaced sides;

a water passageway through the toilet in a generally S-shaped configuration with a generally central P-trap;

a cutout in the rear of the toilet, the cutout having a vertical exterior edge, a vertical interior edge, a generally horizontal lower edge and a generally horizontal upper edge, the edges together forming a continuous bearing surface;

a removable panel shaped generally as a mirror image of the toilet between the upper and lower edges of the cutout, the removable panel having a continuous bearing surface positionable to overlie the bearing surface of the cutout; and mating flanges on the panel and the toilet adjacent to the bearing surfaces, the flanges being formed with holes, bolts extending through the holes with nuts coupled to the bolts to allow separating the panel from the toilet.

2. The system as set forth in claim 1 and further including:

a gasket shaped to correspond to the bearing surfaces of the cutout and the panel, the gasket positioned between the cutout and the panel during operation and use of the toilet for abating water leakage.

3. The system as set forth in claim 2 wherein the gasket is fabricated of an elastomeric material.

4. The system as set forth in claim 1 and further including:

a tank secured to the toilet, extending upwardly from the rear of the toilet, and adapted to contain a quantity of water for passage through the toilet to flush material through the toilet.

5. A toilet access panel system for cleaning out clogs of material in P-traps of toilets, the cleaning out being achieved in a relatively clean, convenient and economical manner, the system comprising, in combination:

a toilet fabricated of porcelain and having an open top for the receipt of material to be flushed away, a bottom positionable on a recipient surface, a front in a broadly curved configuration, a rear in a narrowly curved configuration, and laterally spaced sides, the toilet having a vertical central plane and being symmetric about the vertical central plane;

a tank secured to the toilet, extending upwardly from the rear of the toilet, and adapted to contain a quantity of water for passage through the toilet to flush material through the toilet;

a water passageway through the toilet from the top to the bottom in a generally S-shaped configuration, the S-shaped configuration including a central P-trap in a generally inverted U-shaped configuration, the P-trap adapted to preclude the upward flow of unpleasant gasses from beneath the toilet, the P-trap creating a region susceptible of retaining a clog of unwanted material during a flushing which, if not unclogged, will result in an overflowing of the toilet;

a cutout in the rear of the toilet, the cutout having a vertical exterior edge in the vertical plane of the toilet and forming a bearing surface in a generally S-shaped configuration, the cutout having a vertical interior edge forming a bearing surface in a generally S-shaped configuration at a fixed distance from the exterior edge, the cutout having a generally horizontal lower edge forming a bearing surface in a generally C-shaped configuration adjacent to the bottom of the toilet and the cutout having a generally horizontal upper edge forming a bearing surface in a generally C-shaped configuration adjacent to the top of the toilet;

a removable panel shaped generally as a mirror image of the toilet between the upper and lower edges of the cutout, the removable panel having bearing surfaces positionable to overlie the bearing surfaces of the cutout;

a gasket shaped to correspond to the bearing surfaces of the cutout and the panel, the gasket positioned between the cutout and the panel during operation and use of the toilet for abating water leakage, the gasket being fabricated of an elastomeric material; and mating flanges on the panel and the toilet adjacent to the vertical edges, the mating flanges including a short flange near the exterior and horizontal edges, a long flange above the short flange and an intermediate flange along the interior edge, the flanges being formed with holes, bolts extending through the holes with nuts coupled to the bolts to allow separating the panel from the toilet for the purpose of removing clogs.

* * * * *